US005626067A

United States Patent [19]

Lothe

[11] Patent Number: 5,626,067

[45] Date of Patent: May 6, 1997

[54] SLICER GUIDE

[75] Inventor: Arlan D. Lothe, Sun Prairie, Wis.

[73] Assignee: McGowan Manufacturing Co., Hutchinson, Minn.

[21] Appl. No.: 348,047

[22] Filed: Dec. 1, 1994

[51] Int. Cl.[6] ..... B26D 7/01

[52] U.S. Cl. ..... 83/761; 83/451; 83/932; 269/289 R

[58] Field of Search ..... 83/762, 761, 451, 83/932; 269/289 R, 290, 295, 302.1

[56] References Cited

U.S. PATENT DOCUMENTS

| | | | |
|---|---|---|---|
| 66,402 | 7/1867 | Schwartz . | |
| 489,457 | 1/1893 | Cameron . | |
| 571,349 | 11/1896 | Farquher . | |
| 802,237 | 10/1905 | Quirk, Jr. . | |
| 1,702,144 | 2/1929 | Weston . | |
| 2,452,445 | 10/1948 | Ericsson | 146/215 |
| 2,609,024 | 9/1952 | Russ | 146/215 |
| 4,125,046 | 11/1978 | Kroh et al. | 83/762 X |
| 4,131,043 | 12/1978 | Colman et al. | 83/761 X |
| 4,152,963 | 5/1979 | Romanik et al. | 83/762 X |
| 4,243,184 | 1/1981 | Wright | 269/289 R X |
| 4,399,989 | 8/1983 | Baillie | 269/87.2 |
| 4,550,636 | 11/1985 | Josselson et al. | 83/743 |
| 4,798,372 | 1/1989 | Tingle | 269/59.5 |
| 4,807,505 | 2/1989 | Campbell et al. | 83/454 |
| 5,090,286 | 2/1992 | Ward | 83/761 |
| 5,148,731 | 9/1992 | Boerner | 83/932 X |
| 5,386,755 | 2/1995 | Schneider et al. | 83/762 X |

*Primary Examiner*—Rinaldi I. Rada
*Assistant Examiner*—Boyer Ashley
*Attorney, Agent, or Firm*—Westman, Champlin & Kelly, P.A.

[57] ABSTRACT

A slicer guide suitable for use with a food item such as a loaf of bread, certain vegetables or the like is provided. The slicer guide includes a base having a generally planar upper surface. A flange is affixed to the base. The flange includes a top surface suitable for guiding a knife as it travels alongside the top surface, and a plurality of spaced-apart generally parallel grooves therein. A cutting board having a generally planar cutting surface suitable for abutting the product to be sliced thereon is adapted for slidable insertion into a selected groove. The slicer guide is used with the knife and the product to provide slices of thicknesses corresponding with the selected groove. The slicer guide is generally used for food items including bread and items such as cucumbers, tomatoes, peppers, mushrooms and the like.

10 Claims, 5 Drawing Sheets

SLICER GUIDE

BACKGROUND OF THE INVENTION

This invention relates to a device for controlling the slicing of products such as food. More particularly, the present invention relates to a slicer guide that can be adjusted for obtaining different width slices of the product.

The hand slicing of food items is often a time consuming and frustrating process. It is also very difficult to achieve a uniform thickness slice when cutting several slices by hand. It is even more difficult to obtain uniform flat slices if the item to be sliced is a relatively delicate product such as bread or a tomato. It is difficult to cut these food items without damage to the shape or appearance of the product.

When preparing food, often times it is desirable to have several slices of uniform thickness. Also, a food preparer may wish to prepare several items of food in which generally straight slices of different thickness are desired. For this, there is a need for a relatively simple device which allows the food preparer to obtain a number of predetermined uniform-thickness slices wherein the device can be adjusted to the proper size quickly and easily.

SUMMARY OF THE INVENTION

The present invention is directed to a product slicer guide suitable for use with a food item such as a loaf of bread, certain vegetables or the like. The slicer guide includes a base having a generally planar upper surface. A flange is affixed to the base. The flange includes a top surface suitable for guiding a knife as it travels alongside the top surface, and a plurality of spaced-apart generally parallel grooves therein. A cutting board having a generally planar cutting surface suitable for abutting the product to be sliced thereon is adapted for slidable insertion into a selected groove. The slicer guide is used with the knife and the product to provide slices of different thicknesses corresponding with the selected groove. The slicer guide is generally used for food items including bread and items such as cucumbers, tomatoes, peppers, mushrooms and the like.

DETAILED DESCRIPTION OF THE PREFERRED EMBODIMENTS

Figure 1:
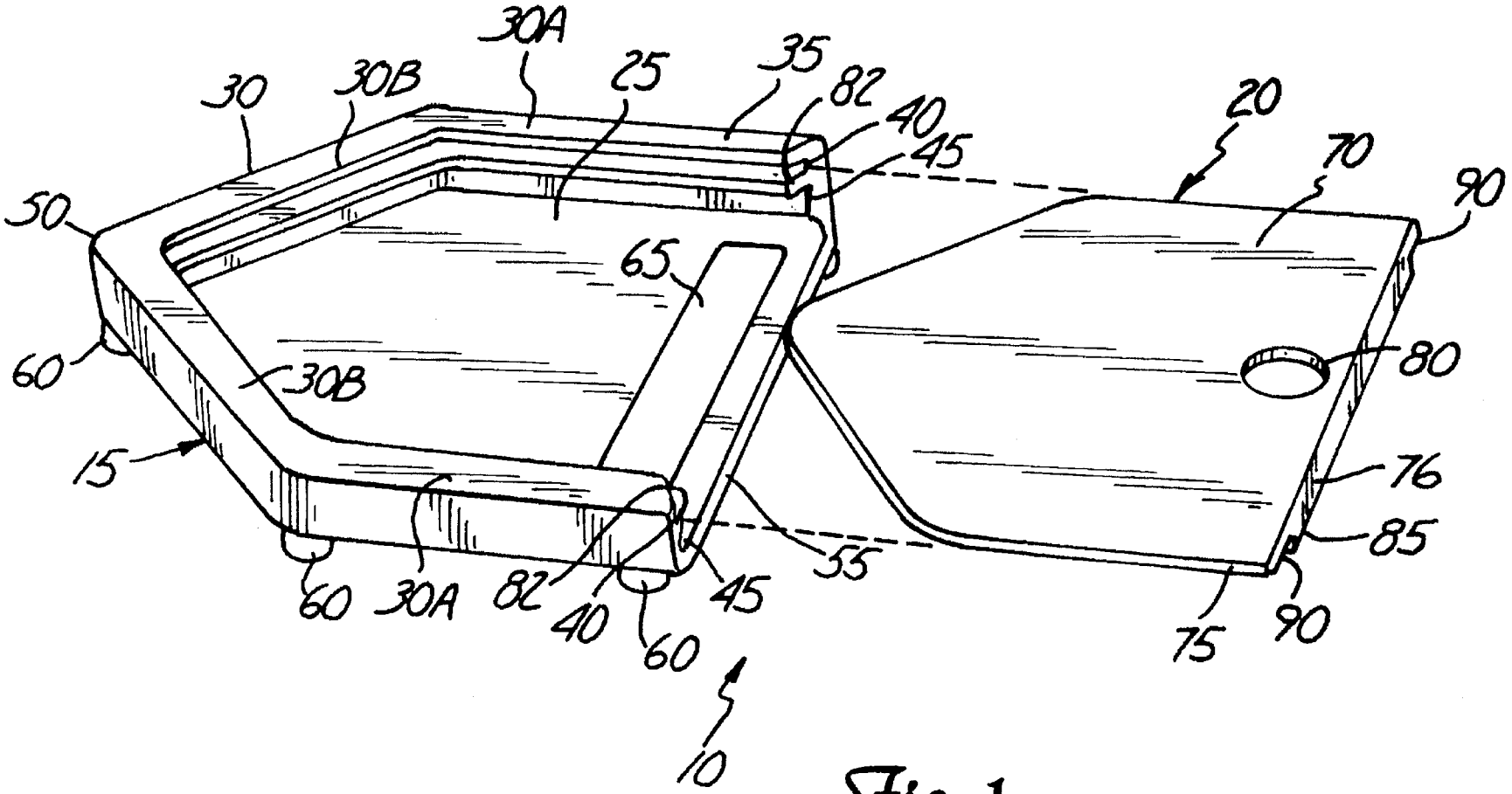
FIG. 1 is a perspective view of a slicer guide device embodying features of the present invention.

FIG. 1 is a perspective view of a slicer guide indicated generally at 10, comprising a base 15 and a cutting board 20.

The base 15 includes a base surface 25 and a flange 30. The flange 30 has side portions 30A formed by tapered portions 30B that meet at an endpoint of the flange 30 defines a top, generally planar cutting guide surface 35. Also, the flange 30 includes a plurality of grooves 40 and 45. A closed end of the flange 30 formed by tapered portions 30B is generally triangular shaped and is closed at end point member 50. The flange 30 also has an open end 55 preferably opposite the point member 50 and formed by the side portions 30A. A plurality of "non-skid" feet 60 are affixed to the base 15 on the underside of the base surface 25. The base surface 25 also can include a juice groove 65 near open end 55.

Figure 1A:
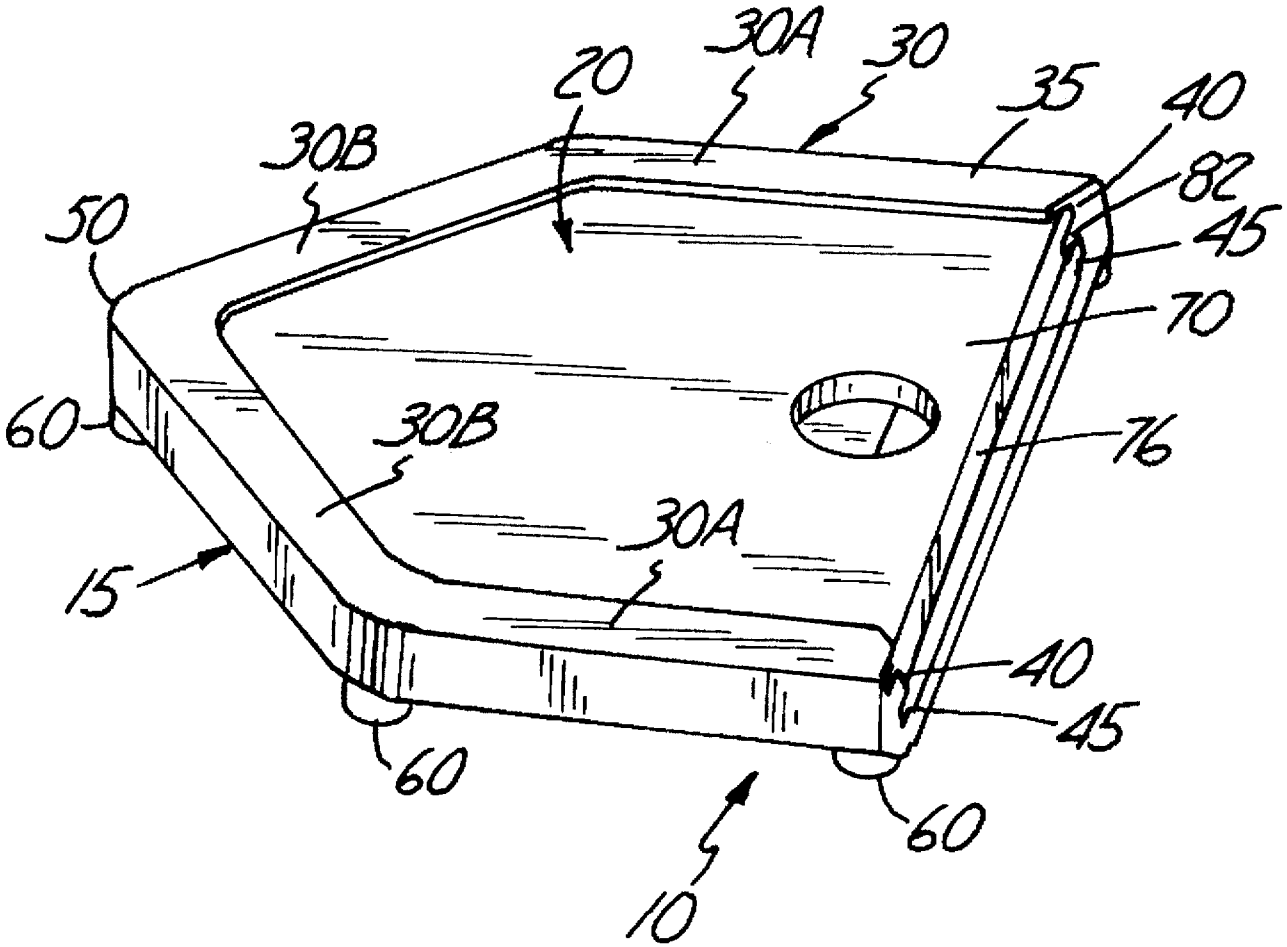
FIG. 1A is another perspective view of the device of FIG. 1.

The cutting board 20 is made to be inserted in either groove 40 or 45 and comprises a generally planar first cutting surface 70 shaped to fit within the flange 30 and has an edge tongue 75 that fits into either groove 40 or 45, as shown in FIG. 1A and edge 76. The cutting board 20 can include an aperture 80 for grasping to insert and remove the cutting board 20 from the base 15.

The base 15 is preferably constructed from laminated hardwood for strength and to prevent warping. The hardwood is provided with a food-safe oil finish. The base surface 25 is preferably generally planar with the juice groove 65 formed therein. The feet 60 are preferably fastened to the underside of the base surface 25 to provide a non-slip contact with a countertop, table, or the like.

The flange 30 is preferably formed from the same piece of laminated hardwood used to make the base surface 25. The cutting guide surface 35 on top of the flange 30 preferably is generally planar and lies in a plane parallel to the plane of the base surface 25. The two grooves 40 and 45 extend the length of the flange 30 and are formed to be in planes also parallel to the base surface 25. A support member 82 separates the grooves 40 and 45. The grooves 40 and 45 are wide enough to allow the tongue 75 on the perimeter of cutting board 20 to be inserted therein. The distance from the plane of groove 40 to the plane of cutting guide surface 35 is preferably the same as the distance from the plane of groove 45 to the plane of the groove 40. In other words, groove 45 is preferably twice the distance from the cutting guide surface as groove 40. Preferably, the base surface 25 serves to define part of groove 45.

The cutting board 20 is also preferably planar and can slide within groove 40 or 45 against the groove surfaces in tapered portions 30B of the flange 30 when fully inserted. The cutting board 20 is preferably made from a food-safe polymeric material such as polyethylene. The first cutting surface 70 is preferably planar.

Figure 2A:
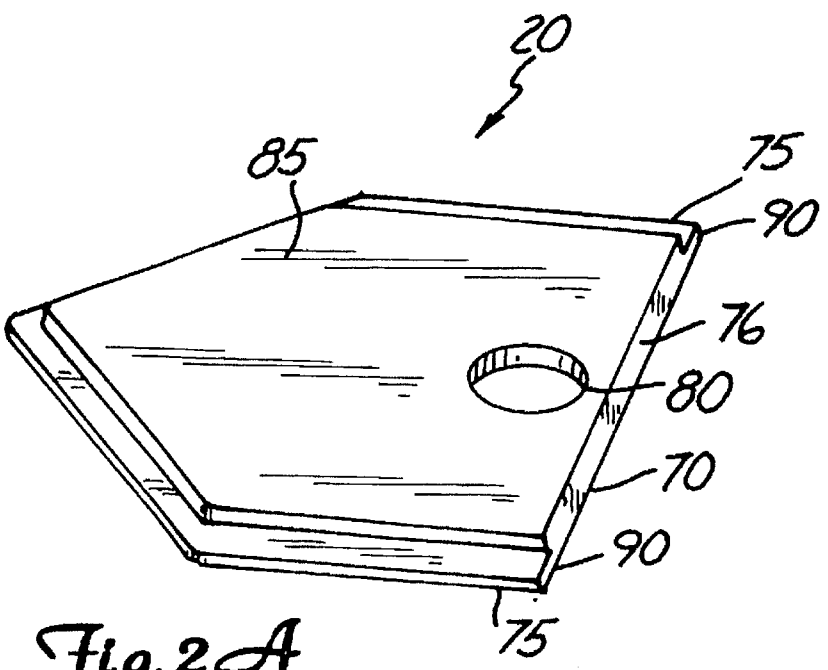
FIG. 2A is a view of the cutting board portion of FIG. 2, with the cutting board inverted.
Figure 2:
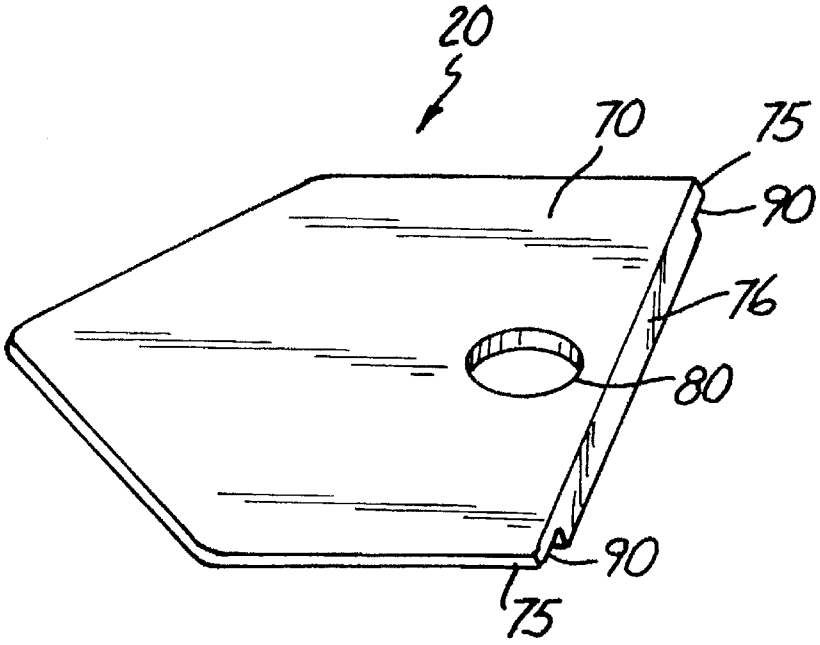
FIG. 2 is a detailed perspective view of a cutting board portion of the device of FIG. 1.

As shown in FIG. 2A, the underside of the first cutting surface includes a second cutting surface 85 which is also preferably planar and parallel to the plane of the first cutting surface 70. The underside surface 90 of tongue 75 is also preferably parallel to the plane of the second cutting surface 85. The tongue 75 is of an appropriate thickness to fit within one of the grooves 40 and 45. The thickness of the cutting board 20 between the cutting surfaces 70, 85 is greater than the thickness of the tongue 75. The aperture 80 serves as a finger hole for easy insertion and removal of the cutting board 20 into and from the base 15.

Figure 4:
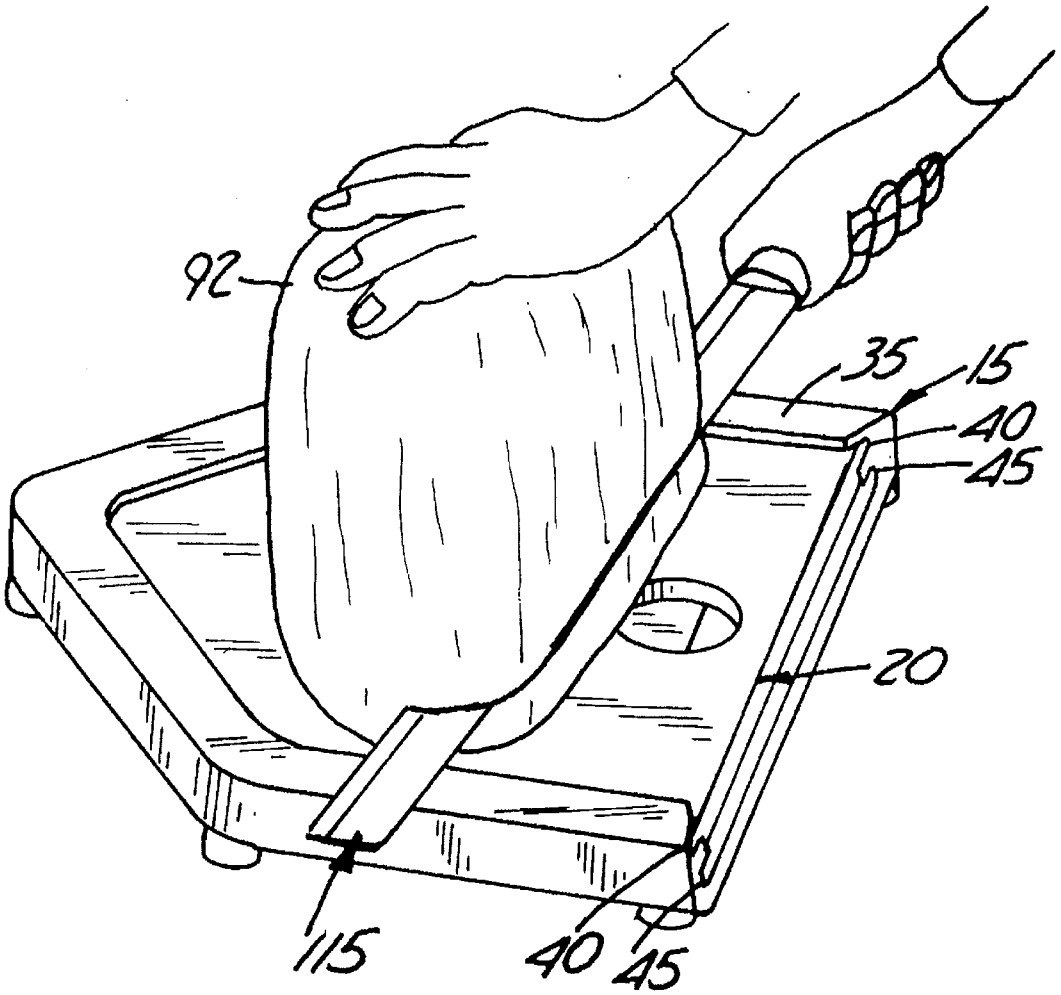
FIG. 4 is a perspective view of the device of FIG. 1 in use.

In operation, as shown in FIG. 4, a food item 92, such as bread, is abutted against the cutting board 20 inside flange 30. The food item 92 can be urged against the tapered portion 30B of the flange 30 for additional support when cutting. A knife blade 115 is preferably layed flat against the cutting guide surface 35 and is used to cut through the food item 92. The result is a slice of a known thickness made with a straight cut. The known thickness is the distance from upper surfaces 70 or 80 of the cutting board 20 to the plane of the cutting guide surface 35. Cutting into the food item 92 a second time, after removal of the first slice, yields another slice having the known uniform thickness. The cutting board 20 can be inserted into groove 40, flipped end-for-end, inserted into groove 45, and removed completely to be used for obtaining different thickness slices.

Figures 3A, 3B, 3C, 3D:
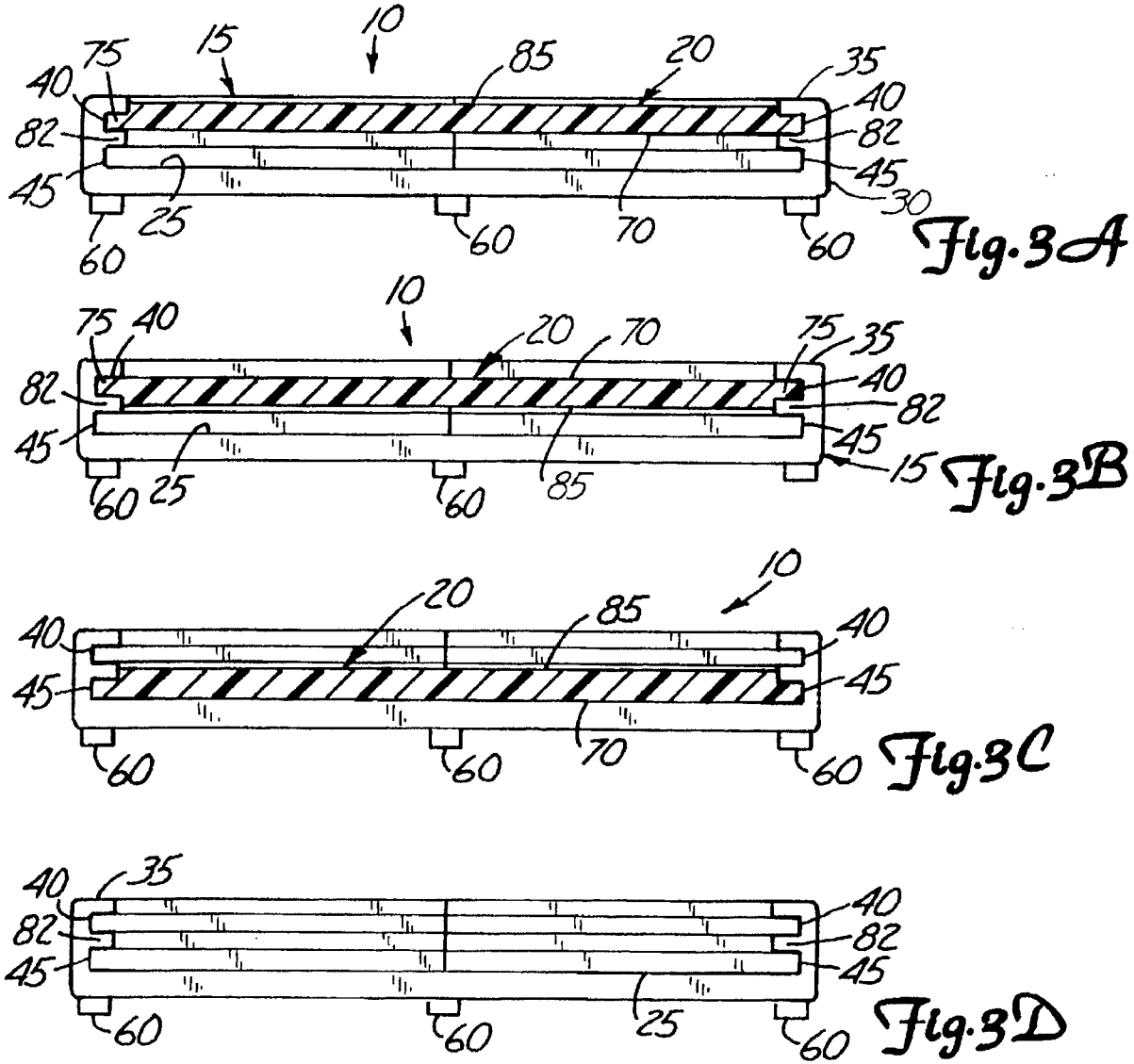
FIG. 3A is an end view of the device of FIG. 1 wherein the cutting board is in a configuration for operation and is sectioned for illustrative purposes.
FIG. 3B is an end view of the device of FIG. 1 in another configuration.
FIG. 3C is an end view of the device of FIG. 1 in another configuration.
FIG. 3D is an end view of the device of FIG. 1 in another configuration.

As shown in FIGS. 3A–3C, the cutting board 20 can be inserted into the grooves 40 and 45 preferably in any one of three possible configurations wherein each configuration is used to obtain slices of different known thicknesses. In each of the configurations shown in FIGS. 3A–3C, respectively, the cutting surface 70 or 85 is at a different distance from the cutting guide surface 35. Typically FIG. 3A gives a ⅛ inch thick slice and slices of ¼", ½" and ¾" are produced in the configurations of FIGS. 3B–3D, respectively.

In FIG. 3A, the second cutting surface 85 is toward the cutting guide surface 35 and the first cutting surface 70 is toward the support member 82. The configuration can be used for cutting relatively thin slices, such as slices of provolone as needed. In FIG. 3B, the cutting board 20 is flipped end-for-end so that the first cutting surface 70 is toward the cutting guide surface 35 and the second underside shoulder surface 90 is resting on the support member 95. This configuration is used to obtain a slice that is thicker than that obtained with the configuration of FIG. 3A, and can be used, for example, when cutting slices of bread. In FIG. 3C, the cutting board 20 is inserted into groove 45 and the second cutting surface 85 is toward the cutting guide surface 35. In the configuration of FIG. 3C, the first cutting surface 70 rests on the base surface 25. The configuration of FIG. 3C can be used, for example, when cutting thicker slices of bread and for specialty breads. The greatest distance from the cutting guide surface 35 is achieved if the cutting board 20 is removed entirely as shown in FIG. 3D. This configuration yields the thickest slice and can be used, for example, when cutting texas toast or slices of french bread.

The slicer guide 10 includes several beneficial features. A finger hole is provided for easy insertion and removal of the cutting board.

Also, when cutting fruits, vegetables or meat, juice from the food item drains from the cutting surface 70 or 85 and is collected in the juice groove 65 to keep the work area clean.

The slicer guide 10 has many advantages. Among these include providing a means for obtaining slices of approximately the same width. Slices of approximately the same width provide more uniform cooking or controlled portions. When uniform slices are not desired, the cutting board 20 can be removed from the base 15 and used by itself. The materials used in fabricating the slicer guide 10 can be easily cleaned by rinsing with water or washing by hand. The rubber feet 60 provide support and firm contact with countertops, tables, or the like. Those with a limited range of motion in hands and arms find use of the cutting surface helpful when cutting food. Also, slice thickness can be adjusted quickly and easily.

Although the present invention has been described with reference to preferred embodiments, workers skilled in the art will recognize that changes may be made in form and detail without departing from the spirit and scope of the invention.

What is claimed is:

1. A slicer guide, suitable for use with a sliceable food item and a blade, the slicer guide comprising:

a base having a generally planar upper surface suitable for abutting the food item thereon;

a flange affixed to the base, the flange having:

a top surface spaced-apart from the base and suitable for guiding the blade when sliding along the top surface; and a plurality of spaced-apart generally parallel grooves formed therein, the grooves being spaced-apart from the top surface and the base; and a cutting board having:

a generally planar first cutting surface also suitable for abutting the food item thereon;

a generally planar second cutting surface also suitable for abutting the food item thereon;

an edge proximate the first cutting surface and the second cutting surface;

a tongue having a first tongue surface and a second tongue surface, the tongue affixed to the edge wherein a first distance from the first tongue surface to the first cutting surface is different from a second distance from the second tongue surface to the second cutting surface; and wherein the tongue is slidable within and into a selected groove in a first orientation having the first-mentioned cutting surface toward the upper surface and in a second orientation having the second cutting surface toward the upper surface to provide varied thickness corresponding with the orientation of the cutting board within the selected groove.

2. The slicer guide of claim 1 wherein the flange is formed into a generally triangular shape at one end and having an open end for insertion of the cutting board.

3. The slicer guide of claim 1 wherein the first tongue surface is coplanar with the first cutting surface.

4. The slicer guide of claim 1 wherein:

the top surface of the flange lies in a plane generally parallel to the upper surface of the base; and the grooves of the flange are generally parallel to the upper surface of the base.

5. The slicer guide of claim 4 wherein the base includes a juice groove formed therein.

6. A slicer guide comprising:

a flange having:

a generally planar cutting guide surface for guiding a blade traveling thereon; and a plurality of spaced-apart grooves, formed in the flange and disposed generally parallel to, but spaced-apart from, the cutting guide surface; and a removable cutting board having:

a peripheral edge;

a tongue having a first tongue surface and a second tongue surface generally opposite the first tongue surface, the tongue disposed along at least a portion of the peripheral edge;

a first cutting surface; and a second cutting surface wherein a first distance from the first cutting surface to the first tongue surface is different than a second distance from the second cutting surface to the second tongue surface;

the removable cutting board for insertion in one of two orientations with respect to the flange by sliding the tongue into a selected one of the grooves.

7. The slicer guide of claim 6 wherein the first tongue surface is coplanar with the first cutting surface.

8. The slicer guide of claim 6 wherein the flange includes a generally triangular-shaped end and has two spaced apart side portions defining an open end suitable for accepting the insertion of the cutting board.

9. The slicer guide of claim 6 wherein the cutting guide surface is generally planar and the slicer guide further comprises a generally planar base affixed to the flange wherein the base is generally parallel to the cutting guide.

10. The slicer guide of claim 9 wherein the base includes a juice groove in an upper surface thereof.

* * * * *